US006666810B1

(12) United States Patent
Roeters et al.

(10) Patent No.: US 6,666,810 B1
(45) Date of Patent: Dec. 23, 2003

(54) DEVICE FOR CONTROLLABLE STRETCHING OF THIN MATERIALS

(75) Inventors: Glen Roeters, Huntington Beach, CA (US); Boris Moldavsky, Irvine, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/545,743

(22) Filed: Apr. 4, 2000

Related U.S. Application Data

(63) Continuation-in-part of application No. 09/330,369, filed on Jun. 11, 1999, now abandoned.

(51) Int. Cl.[7] ..... B31B 1/00
(52) U.S. Cl. ..... 493/465; 493/475; 493/478
(58) Field of Search ..... 254/199, 253, 254/201; 493/465, 475, 478

(56) References Cited

U.S. PATENT DOCUMENTS 4,233,801 A 11/1980 Watt ..... 53/453
4,699,606 A * 10/1987 Whitley, Jr. et al.
5,159,751 A * 11/1992 Cottingham et al.
5,261,593 A * 11/1993 Casson et al.
5,645,267 A * 7/1997 Reeve et al.
5,759,269 A * 6/1998 Cutting et al.
5,775,395 A * 7/1998 Wilkins
5,810,233 A * 9/1998 Varidel ..... 493/373
5,893,825 A * 4/1999 Rebeaud ..... 493/373
6,095,962 A * 8/2000 Rebeaud ..... 493/373

* cited by examiner

*Primary Examiner*—Eugene Kim

(57) ABSTRACT

A worktable that can be used to support a substrate while forming a hole therein. The worktable may include one or more actuators that stretch the substrate. The worktable may also have a control unit that is connected to the actuators and strain gauges that sense the strain in the substrate. The control unit, actuators and strain gauges may provide a closed loop control system for tensioning the substrate. The center portion of the substrate may be supported by wires that extend across an opening in the worktable. The opening eliminates a backing surface that may interfere with a laser hold forming process.

6 Claims, 3 Drawing Sheets

DEVICE FOR CONTROLLABLE STRETCHING OF THIN MATERIALS

This is a division continuation-in-part of U.S. Application No. 09/330,369, filed Jun. 11, 1999, now abandoned herein incorporated by reference in its entirety.

FIELD OF THE INVENTION

The present invention relates to a worktable that can be used to form a hole in a substrate. The substrate may be a flexible polyimide material that is subsequently assembled into a flexible circuit board of an electronic assembly.

BACKGROUND OF THE INVENTION

Electronic assemblies may incorporate flexible circuit boards to provide an interconnect between integrated circuits and/or integrated circuit packages. The flexible circuit boards may contain patterned conductive material located on opposite surfaces of a flexible dielectric substrate. It may be desirable to create through holes/vias in the dielectric material to connect the conductive material on one side of the substrate to the conductive material on the other side of the substrate. a The vias are typically formed by initially creating holes in the substrate. The substrate is then placed in a plating bath to form the vias.

The holes can be created with a laser that scans a sheet of dielectric material mounted to a worktable. The dielectric material is typically secured to a surface of the worktable with tape. It is important to maintain the flatness of the dielectric material to insure the accuracy of the laser hole forming process.

Although the dielectric material is typically stretched onto the worktable, the tape has been found to be insufficient in maintaining the flatness of the material. Additionally, it is desirable to provide a worktable that has no backing material to insure proper operation of the laser. A backing material may cause an undesirable reflection of the laser beam and contamination of lased holes. It would therefore be desirable to provide a worktable that can provide sufficient tension to a dielectric material. It would also be desirable to provide a worktable that sufficiently tensions a dielectric material but does not have a backing surface.

SUMMARY OF THE INVENTION

One embodiment of the present invention is a worktable that can be used to support a substrate while forming a hole therein. The worktable may have an actuator that pulls the substrate.

DETAILED DESCRIPTION

Figure 1:
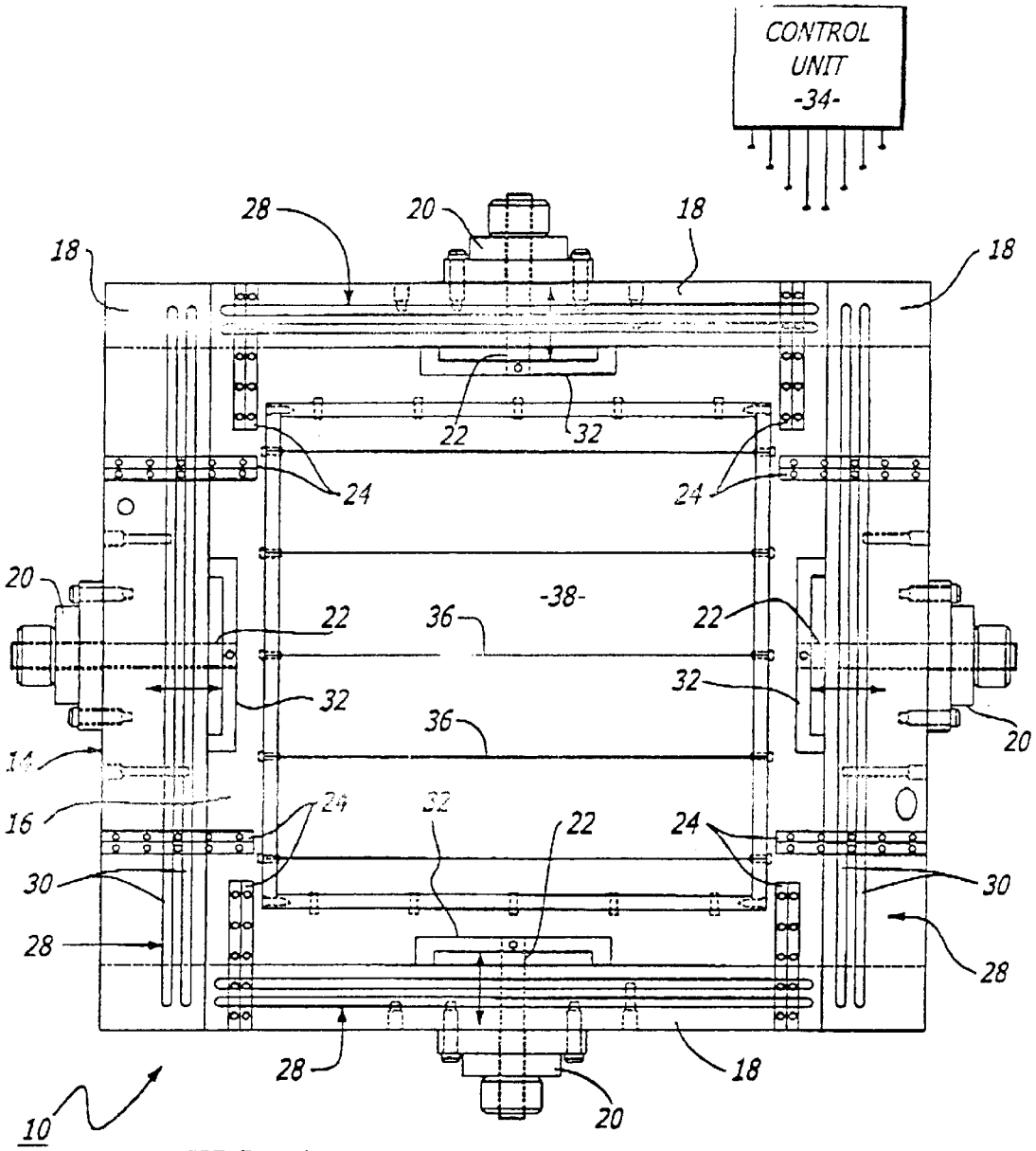
FIG. 1 is a top view of an embodiment of a worktable of the present invention.
Figure 2:
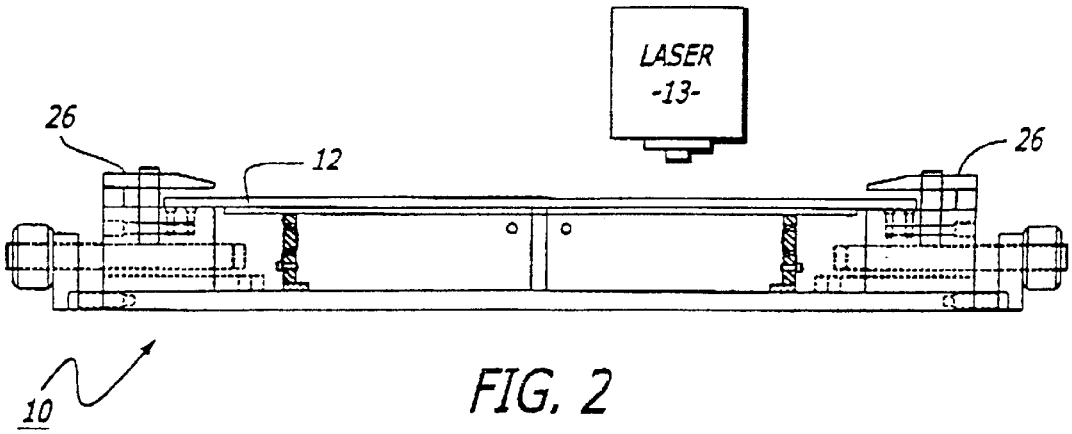
FIG. 2 is a front view of the worktable.

Referring to the drawings more particularly by reference numbers, FIGS. 1 and 2 show an embodiment of a worktable

10 of the present invention. The worktable 10 can be used to hold a substrate 12. By way of example, the substrate 12 may be a flexible polyimide material typically used in flexible circuit boards. Alternatively, the substrate 12 may be a polyester film, a fluoropolymer, a copper foil film, or an epoxy glass film. A laser 13 may form holes (not shown) within the substrate 12. The holes can be. subsequently filled with a conductive material to form vias (not shown) in the substrate 12. Although a laser 13 is shown and described, it is to be understood that the holes may be formed by other means including mechanical drills or punches.

The worktable 10 may include a base table 14 that supports the substrate 12. The base table 14 may include a centerpiece 16 and a plurality of leafs 18. The worktable 10 may further have a plurality of actuators 20 that can move the leafs 18 relative to the centerpiece 16 and stretch the substrate 12. Each actuator 20 may be attached to a leaf 18 and have a plunger 22 that engages a side surface of the centerpiece 16. The plunger 22 can move in a linear manner to move the leaf 18 away from, or toward, the centerpiece 16 as indicated by the arrows. The table leafs 18 may be coupled to the centerpiece 16 by a plurality of linear bearings 24 to insure linear movement of the leafs 18. Four actuators 20 may be provided to pull each edge of the substrate 12. Although four actuators 20 are shown and described, it is to be understood that the worktable 10 may have any number of actuators 20. The actuators 20 may be hydraulic, pneumatic, electro-mechanical, piezoelectric, or any other device that can move the leafs 18 relative to the centerpiece 16.

Each side of the worktable 10 may have a clamp 26 that can secure the edges of the substrate 12. Each clamp 26 can be moved between an open position and a closed position by solenoid or an actuator (not shown). The worktable 10 may also have a plurality of vacuum chucks 28 that hold that substrate 12 in place while being clamped by the clamps 26. Each vacuum chuck 28 may have a pair of channels 30 in fluid communication with a source of vacuum such as a compressor (not shown).

Each actuator 20 may be coupled to a strain gauge 32 attached to the centerpiece 16 of the table 14. The strain gauges 32 and actuators 20 may be connected to an electronic control unit 34 to form a closed loop feedback system. The control unit 34 may provide output signals to activate the actuators 20 and stretch the substrate 12. The control unit 34 may receive input signals from the strain gauges 32 that correspond to the strain on each edge of the substrate 12. The control unit 34 may compare the actual strain values to desired strain values. The desired values may correspond to a desired tension of the substrate 12. In operation, the control unit 34 may activate the actuators 20 and pull the substrate 12 until the actual strain values sensed by the strain gauges 32 equal the desired strain values. Once the desired strain valve is achieved, one or more processes may be performed on the tensioned substrate. For example, the laser 13 can then form the holes in the substrate 12. It is understood that other processes, as known in the technology industry, may be performed on the tensioned substrate.

Providing four different actuators 20 allows the control unit 34 to vary the strain for each edge of the substrate 12. For example, for a rectangular, non-square substrate that has a length longer than a width it may be desirable to have a larger force along the length of the substrate 12 than along the width of the substrate 12. The control unit 34 can be programmed to activate the actuators 20 to obtain such a desired result. The control unit 34 can also be programmed to vary the time rate of change of the strain to obtain an optimum result. The desired strain values may be provided by an operator through an input panel (not shown) of the control unit 34.

The control unit 34 and actuators 20 allow an operator to vary the desired strain values based on the type of material and the shape of the substrate 12. The present invention thus provides a worktable that allows an operator to control the tensioning of a material to a desired level. Stretching the substrate 12 can insure an adequate flatness during the hole forming process (or other processes).

Figure 3:
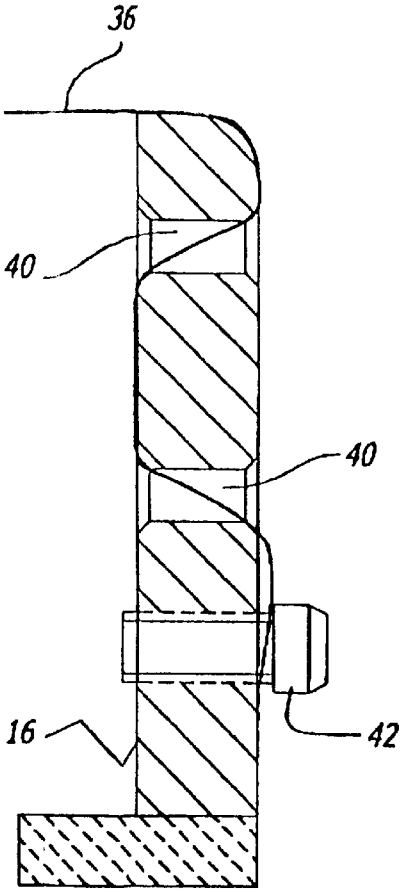
FIG. 3 is an enlarged side view of a section of the worktable.

The centerpiece 16 may include a plurality of wires 36 that extend across a center opening 38. The wires 36 can support the substrate 12 while not creating a backing surface that will interfere with the process of forming the holes with the laser 13. As shown in FIG. 3, each wire 36 can be routed through a pair of apertures 40 and attached to the centerpiece 16 by a fastener 42. The wires 36 preferably have a tension sufficient to support the substrate 12 without any significant reduction in substrate flatness.

Figure 6:
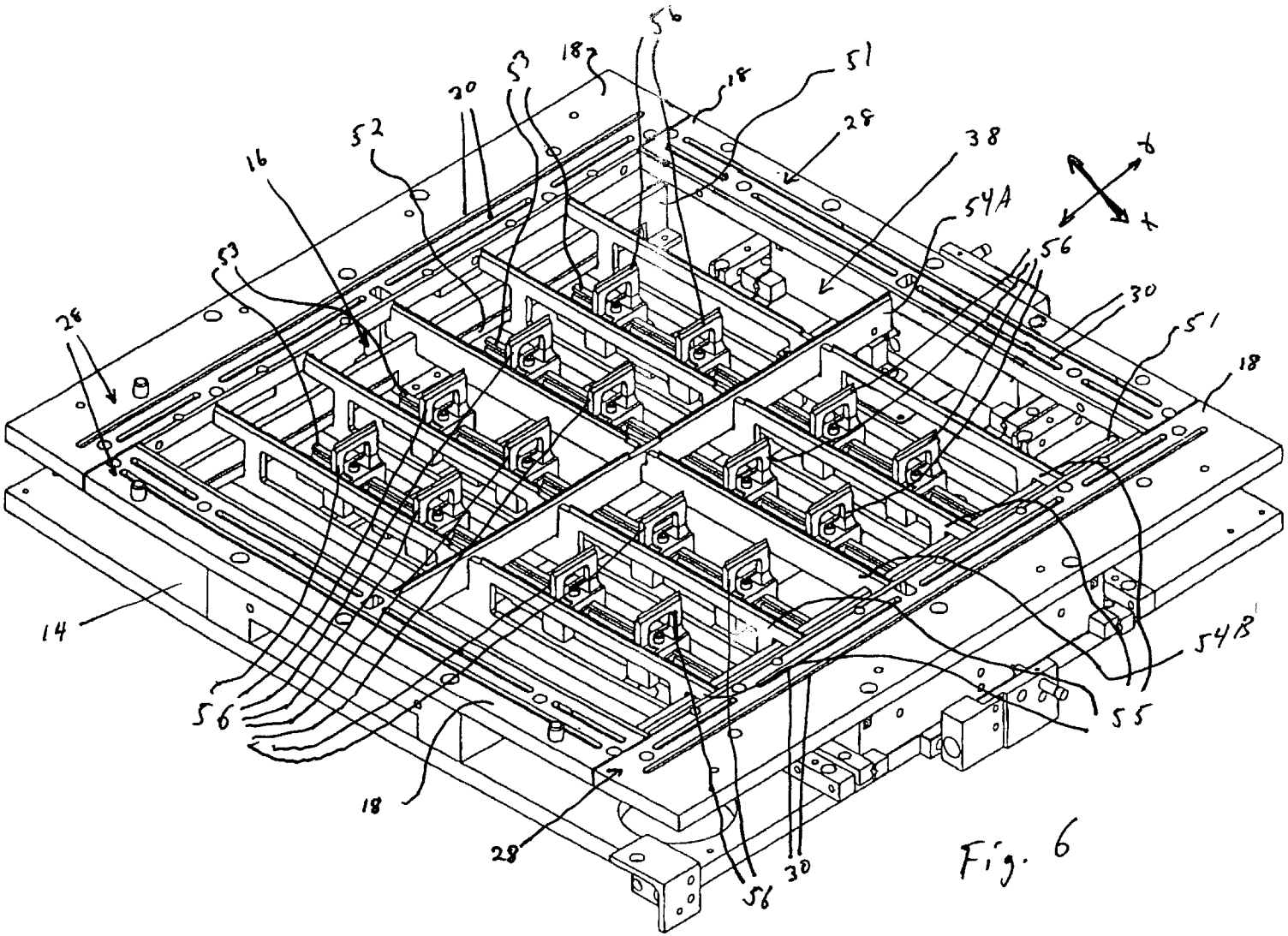
FIG. 6 is a perspective view of a worktable incorporating preferred centerpiece.

Referring to FIG. 6, a preferred centerpiece 16 utilizes adjustable wiper blades 54–56 in place of wires 36 to provide supporting members which can be adjusted to accommodate different drilling patterns. Such a centerpiece 16 may utilize two wiper blades 54A and 54B to divide the centerpiece into four quadrants with 54B establishing an X axis and 54A establishing a Y axis. A series of parallel long wiper blades 55 may be spaced at adjustable intervals along the Y axis. Long blade supports 51 provide a mechanism for retaining long wiper blades 55 is a preferred configuration. Long blade support 51 are preferred to comprise a biased/spring mounted bar 52 wherein bar 52 is used to apply pressure to a portion of long wiper blades 55 such that the blades remain in position during operation of the worktable 10, and insure that the upper surfaces of long wiper blades 55 are coplanar by insuring that wiper blades 55 are positioned snugly against the upper surfaces of long blade supports 51.

It is also preferably that short wiper blades 56 be positioned between the long wiper blades 55 to provide additional support. Short wiper blades are preferably adjustably mounted to short blade supports 53 such that individual short wiper blades 56 can be moved parallel to the X axis established by blade 54B to adjust the spacing between short wiper blades 56. Short blade support 53 are preferably movable along the Y axis to permit the adjustments in spacing relative to other groups of short wiper blades 53 and to long wiper blades 55.

Wiper blades preferably comprises surface contacting/blade portion and a blade support portion with the dimensions and choice of material of the blade portion being chosen to facilitate positioning and removing the substrate while providing adequate support and the blade support portion being designed to provide adequate support to the blade portions without taking up an undo amount of space. It should be noted that the number of long wiper blades 55 and short wiper blades 56 may be increased or decreased to accommodate different substrates 12, centerpieces 16, and or drilling patterns.

It is contemplated that the use of wiper blades 54–56 provide numerous advantages over the use of wires 36. Such advantages include, but are not necessarily limited to: providing additional support to the substrate 12 to prevent sagging of the substrate; eliminates any difficulties caused by having wires 36 bend; providing a support mechanism which is more easily adjustable; providing a support mechanism which can easily be adjusted to accommodate changes in drilling patterns.

The preferred centerpiece 16 of FIG. 6 can be viewed as creating an adjustable grid-like support for substrate 12 wherein the grid comprises a plurality of rectangular cells defined by support members with the dimensions of each cell being adjustable in regard to both length and width.

Figure 4:
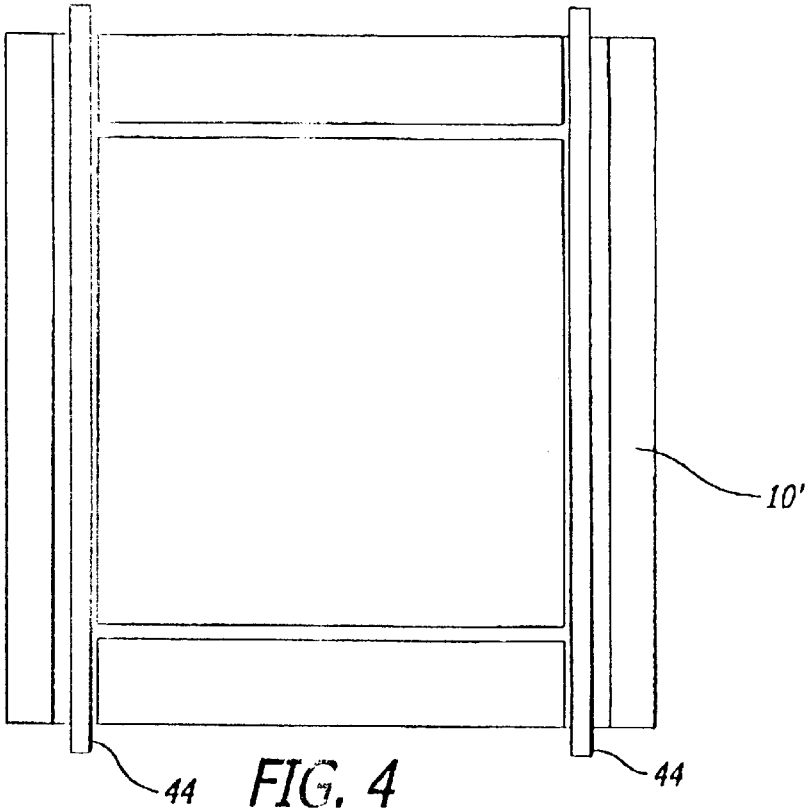
FIG. 4 is a top view of an alternate embodiment of the worktable.
Figure 5:
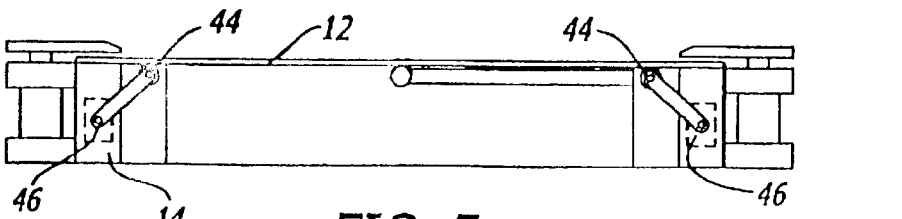
FIG. 5 is a side view of the worktable of FIG. 4.

FIGS. 4 and 5 show an alternate embodiment of a worktable 10', wherein the actuators include rollers 44 that can be pivoted relative to the base table 14. The rollers 44 can be rotated in an upward manner to engage and stretch the substrate 12. The rollers 44 can be rotated by rotary actuators 46 that are connected to a control unit (not shown). The worktable 10' may also have strain gauges (not shown) to provide feedback to the control unit. Additionally, the worktable 10' may have a clamp 26, vacuum chuck (not shown) and support wires (not shown) that function the same or similar to the corresponding components of the embodiment shown in FIGS. 1, 2 and 3.

Thus, specific embodiments and applications of a worktable that can be used to support a substrate while forming a hole therein have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A worktable that can support a substrate, comprising:

a base table comprising a center opening;

a plurality of support members adapted to prevent a substrate positioned over the center opening from sagging into the opening, wherein each support member comprises a blade portion mounted to the upper surface of a bar portion wherein the blade portion differs from that of the bar portion and is adapted to facilitate positioning a substrate on and removing a substrate from the blade portion, and the bar portion is adapted to provide adequate support to the blade portion; and an actuator coupled to the base table and adapted to pull the substrate taut above the center opening.

2. The worktable of claim 1, wherein the plurality of elongated support members forms a substantially planar grid subdividing the center opening into a plurality rectangular cells, the cells being defined by the support members, and the dimensions of each cell being adjustable in regard to both length and width.

3. The worktable of claim 2, wherein:

the plurality of support members comprises a first plurality of elongated parallel support members and a second plurality of elongated parallel support members, wherein the support members of the second plurality of support members are perpendicular to the support members of the first plurality of support members, and the positioning of at least some of the members of the first plurality of support members relative to each other may be adjusted without removing any of the first plurality of support members from the centerpiece;

the positioning of at least some of the members of the second plurality of support members relative to each other may be adjusted without removing any of the second plurality of support members from the centerpiece; and the positioning of at least some of the members of the second plurality of support members relative to a member of the first plurality of support members may be adjusted without removing any support members from the centerpiece.

4. The worktable of claim 3, wherein all of the members of the second plurality of support members are shorter than every member of the first plurality of support members and are positioned between the members of the first plurality of support members.

5. The worktable of claim 4 further comprising a first dividing member and a second dividing member, wherein the first and second dividing members are perpendicular to each other and divide the centerpiece into four equal areas, the first and second dividing members form part of the substantially planar grid of rectangular cells, and the first and second dividing members are fixed in position relative to each other.

6. The worktable of claim 5 further comprising four elongated leaf members forming a rectangular surface around the center piece, the rectangular surface being coplanar with the blade portions of the support members, each leaf member moveably coupled to the center piece via an actuator, each leaf member comprising a corresponding elongated clamp having a length substantially equal to the length of leaf member to which it corresponds.

* * * * *